US005487851A

United States Patent [19]

Dillehay et al.

[11] Patent Number: 5,487,851

[45] Date of Patent: Jan. 30, 1996

[54] COMPOSITE GUN PROPELLANT PROCESSING TECHNIQUE

[75] Inventors: David R. Dillehay; David W. Turner, both of Marshall; Horace L. Wingfield, III, Longview, all of Tex.; James A. Blackwell, Shreveport, La.

[73] Assignee: Thiokol Corporation, Ogden, Utah

[21] Appl. No.: 170,391

[22] Filed: Dec. 20, 1993

[51] Int. Cl.[6] ..... C06B 21/00

[52] U.S. Cl. ..... 264/3.3

[58] Field of Search ..... 264/3.3

[56] References Cited

U.S. PATENT DOCUMENTS

| | | | |
|---|---|---|---|
| 2,768,072 | 10/1956 | Stark | 52/5 |
| 3,138,501 | 6/1964 | Wright | 149/92 |
| 3,173,817 | 3/1965 | Wright | 149/2 |
| 3,400,025 | 9/1968 | Hopper et al. | 149/18 |
| 3,872,192 | 3/1975 | Kaufman et al. | 264/3 B |
| 4,263,070 | 4/1981 | Price et al. | 149/19.4 |
| 4,428,786 | 1/1984 | Arni | 149/21 |
| 4,506,069 | 3/1985 | Barnes et al. | 528/232 |
| 4,525,313 | 6/1985 | Muller | 264/3.3 X |
| 4,554,031 | 11/1985 | Kerviel et al. | 149/19.3 |
| 4,570,540 | 2/1986 | Bell | 102/202 |
| 4,585,600 | 4/1986 | Rollyson et al. | 264/3.3 X |
| 4,650,617 | 3/1987 | Kristofferson et al. | 264/3.3 X |
| 4,726,919 | 2/1988 | Kristofferson et al. | 264/3.3 X |
| 4,919,737 | 4/1990 | Biddle et al. | 149/19.5 |
| 4,931,229 | 6/1990 | Krimmel et al. | 264/3.3 X |
| 4,976,794 | 12/1990 | Biddle et al. | 149/19.5 |
| 5,026,443 | 6/1991 | Müller et al. | 149/18 |
| 5,061,409 | 10/1991 | Dillehay | 264/3.3 X |
| 5,114,630 | 5/1992 | Newman et al. | 264/3.3 X |
| 5,125,684 | 6/1992 | Cartwright | 280/736 |
| 5,266,242 | 11/1993 | Mogendorf et al. | 264/3.3 |

*Primary Examiner*—Peter A. Nelson

*Attorney, Agent, or Firm*—Ronald L. Lyons; Madson & Metcalf

[57] ABSTRACT

A continuous extrusion process for manufacturing composite gun propellant is disclosed. The disclosed process is particularly suitable for preparing gun propellant formulations based upon a cellulose ester binder. In the process, the binder ingredients are dissolved in an organic solvent and then pumped directly into a twin-screw extruder. The other ingredients, except the oxidizer, may optionally be dissolved in the organic solvent prior to introduction into the twin-screw extruder. The oxidizer is dried, ground, and also fed dry to the twin-screw extruder. In the extruder, the materials are thoroughly mixed and the solvent is reduced to sufficient level for direct extrusion through the desired dies.

42 Claims, No Drawings

COMPOSITE GUN PROPELLANT PROCESSING TECHNIQUE

BACKGROUND OF THE INVENTION

1. Field of the Invention

This invention relates to a propellant processing technique. More particularly, the invention relates to a continuous manufacturing process of composite gun propellant using a twin-screw extruder.

2. Technology Background

Gun propellants are basically divided into homogeneous and composite formulations. The homogeneous propellants include single, double, and triple base propellants. Single base propellants are basically nitrocellulose with some ballistic modifiers and stabilizing additives. Double base propellants add nitroglycerine to the nitrocellulose propellant, and triple base propellants further add nitroguanidine. Composite gun propellants offer a broader range of processing characteristics and ballistic parameters. High energy coupled with flame temperature modification provides a broad range of performance characteristics. The binder and plasticizer used has an effect on the susceptibility of the propellant to accidental ignition and the particle size of the oxidizer influences the response of the propellant to unplanned stimuli. For some applications, high energy requirements may override the temperature and vulnerability considerations, thus achieving enhanced performance with accepted risks in propellant hazard or increased barrel wear.

A continuing objective in the design of gun propellants is to provide a gun propellant which is energetic when deliberately ignited, but which exhibits high resistance to accidental ignition from heat, flame, impact, friction, and chemical action. This is especially important in confined quarters such as inside tanks, ships or the like. Propellants possessing such resistance to accidental ignition are known as "low vulnerability ammunition" (LOVA) gun propellants.

Conventional LOVA gun propellants comprise an elastomeric binder, throughout which are dispersed particulates of high-energy material, particularly oxidizers. The two most common oxidizer particulates are RDX (1,3,5-trinitro-1,3,5-triaza-cyclohexane) and HMX (1,3,5,7-tetranitro-1,3,5,7-tetraaza-cyclooctane). Mixtures of these oxidizers may be used.

Another type of LOVA propellant has a binder of cellulose acetate or a cellulose acetate derivative. An example of this type of propellant is described in U.S. Pat. No. 4,570,540, the teachings of which are incorporated herein by reference. These types of LOVA propellants are batch processed using a solvent, which entails relatively long processing times and a large number of steps.

In a typical LOVA gun propellant batch manufacturing process, RDX is dried in a twin-cone blender under vacuum to remove the water and alcohol used to desensitize the RDX during shipping. The RDX is then ground on a fluid energy mill to a weight-mean-diameter of less than 5 microns. The RDX is weighed into a batch size increment for mixing. The other LOVA ingredients include cellulose acetate butyrate (CAB), nitrocellulose (NC), ethyl centralite (EC), a liquid coupling agent, and an energetic plasticizer (EP). The ingredients are all added to a horizontal, sigma blade mixer that has been modified to eliminate seals around the blade shafts. Vertical mixers are precluded from this process because the very high viscosity results in inadequate mixing capability. The ingredients are wet with a mixed ethyl acetate/ethyl alcohol solvent having a solvent ratio of about 76% ethyl acetate to 24% ethyl alcohol. The materials are mixed for several hours to assure that the organic binder materials are dissolved and coated onto the RDX. The temperature of the mixer is controlled during this entire cycle so that the solvent mixture is not removed prematurely. When the mix cycle reaches a proper time, determined by the amount of mix energy introduced into the propellant, a vacuum is applied and the solvent level is reduced over a period of time to the proper operating level.

The mix is then dumped and transferred to the blocking and straining area. Approximately 60 pounds of LOVA is put into a die and pressed into a cylinder approximately 12 inches in diameter and 16 inches long. The block is placed in a ram extruder and pressed through a sieve plate to put additional work into the propellant to improve mixing. The spaghetti-like strands are collected and re-pressed in the die to a 60 pound cylinder. The cylinder is transferred to a large ram press with 30 dies. Each die is approximately 0.33 inch in diameter with a 19 perf pin plate to make a perforated grain for the gun propellant. The 60 pound block is extruded in a vertical plane with each strand being collected in a spiral around a cone beneath the die. As the strands exit the dies, the weight of the strands causes an elongation of the strands and a necking down of the diameter. This produces a variable diameter strand that affects the reproducibility of the grains. The solvent content is approximately 10% during extrusion.

The flexible strands are fed to a rotating blade cutter and cut into pellets approximately 0.5 inches long. The pellets are collected, dried, glazed with graphite to prevent static charges and improve packing, and stored for several weeks to "age" the propellant before it is ballistically accepted. This batch process is costly and very labor intensive. Moreover, the efficiency of the batch mixer produces less than ideal homogeneity and performance reproducibility.

From the foregoing, it will be appreciated that there is a need in the art for continuous composite gun propellant manufacturing processes capable of producing high quality, low cost composite gun propellant.

Such composite gun propellant manufacturing processes are disclosed and claimed herein.

SUMMARY OF THE INVENTION

The present invention is directed to a continuous process for manufacturing composite gun propellant. The process of the present invention may be used to prepare conventional composite, including LOVA, gun propellant formulations based upon a cellulose ester binder. The formulations will typically contain an oxidizer, such as an energetic nitramine, a cellulose ester binder, nitrocellulose, a plasticizer which is preferably energetic, a stabilizer such as ethyl centralite, and an optional liquid coupling agent.

In the process of the present invention, the binder ingredients, i.e., the cellulose ester and nitrocellulose, are dissolved in an organic solvent and then pumped directly into a twin-screw extruder. The other ingredients, except the oxidizer, may optionally be dissolved in the organic solvent prior to introduction into the twin-screw extruder. The oxidizer is dried, ground, and then fed dry to the twin-screw extruder. In the extruder, the materials are thoroughly mixed and the solvent is reduced to sufficient level for direct extrusion through the desired die configuration.

The solvent system will vary depending on the choice of oxidizer and binder. The solvent is selected to dissolve the non-oxidizer ingredients and to adequately wet the oxidizer particles. Suitable solvents are preferably selected from commonly used organic solvents such as ketones, esters, and alcohols. Excess solvent is removed as the ingredients pass through the extruder; however, sufficient solvent must be present during the final extrusion to keep the binder plasticized. A single solvent or a mixed solvent system may be used.

The extruder screw configuration is selected to adequately mix the propellant ingredients, to allow solvent removal, and to provide sufficient extrusion pressure. As the composite gun propellant ingredients pass through the extruder, they are preferably subjected to a temperature profile designed to facilitate mixing and solvent removal. For instance, the temperature at the feed point is preferably sufficiently cool that the solvent is not evaporated until mixing occurs. After mixing, the propellant mixture is heated to evaporate excess solvent. The solvent is collected by vacuum for solvent reclamation. The extrusion is accomplished as the composition reaches the proper solvent level. The strands are cut as they come from the extruder, thereby further reducing handling.

Advantageously, the process of the present invention may be automated and performed remotely, thereby improving safety, quality control, and product reproducibility. This enables the cost of producing composite gun propellants to be substantially lower than by the comparable batch mixing process.

DETAILED DESCRIPTION OF THE INVENTION

The present invention is directed to a continuous process for manufacturing composite gun propellant. The process of the present invention may be used to prepare conventional or LOVA gun propellant formulations containing the following typical ingredients:

| Ingredient | Weight Percent |
|---|---|
| oxidizer | 70–80 |
| cellulose ester | 10–15 |
| nitrocellulose | 2–5 |
| plasticizer | 5–10 |
| stabilizer | 0.2–1 |
| liquid coupling agent | 0–0.5 |

Typical oxidizing agents include high performance solid nitramines such as RDX, HMX, CL-20 (also known as HNIW, 2,4,6,8,10,12-hexanitro-2,4,6,8,10,12-hexaazatetracyclo-[5.5.0.0$^{5,9}$0$^{3,11}$]-dodecane), and mixture thereof.

Examples of common cellulose ester binders which may be use in the composite gun propellant formulations include cellulose acetate (CA), cellulose acetate butyrate (CAB), and cellulose acetate propionate (CAP). Nitrocellulose is a toughener which is preferably included in the gun propellant.

Energetic and nonenergetic plasticizers may be used, depending on whether low energy (LE) or high energy (HE) gun propellants are desired. Known and novel energetic plasticizers may be used, such as bis(2,2-dinitropropyl)acetal/bis(2,2-dinitropropyl)formal (BDNPF/BDNPA), trimethylolethanetrinitrate (TMETN), triethyleneglycoldinitrate (TEGDN), diethyleneglycoldinitrate (DEGDN), nitroglycerine (NG), 1,2,4-butanetrioltrinitrate (BTTN), alkyl nitratoethylnitramines (NENA's), or mixtures thereof. Typical nonenergetic plasticizers include triacetin, acetyltriethylcitrate (ATEC), dioctyladipate (DOA), isodecylperlargonate (IDP), dioctylphthalate (DOP), dioctylmaleate (DOM), dibutylphthalate (DBP), or mixtures thereof.

The stabilizers used in the gun propellant formulations herein also serve to gelatinize the propellant. Suitable stabilizers are usually substitution products of ureas and amines. A currently preferred stabilizer is ethyl centralite (diethyl diphenyl urea). Other diphenyl amines and diphenyl ureas, such as methyl diphenyl urea and ethyl diphenyl urea may also be used herein.

The optional liquid coupling agent (LICA) is designed to help wettability by providing a molecular bridge between the inorganic and organic interfaces in the formulation. A currently preferred liquid coupling agent is titanium(IV) neoalkoxytris(diisoocto)phosphato also known as LICA-12.

In the process of the present invention, the binder ingredients, i.e., the cellulose ester and nitrocellulose, are dissolved in an organic solvent and then pumped directly into a twin-screw extruder. The other ingredients, except the oxidizer, may optionally be dissolved in the organic solvent prior to introduction into the twin-screw extruder. The plasticizers are frequently liquids as are the optional liquid coupling agents, and these could be pumped into the extruder separately. Stabilizers, such as ethyl centralite, are often readily soluble in the solvents and could be fed into the extruder as a powder and dissolved and distributed in the mixer/extruder. The oxidizer is dried, ground on a fluid energy mill, and then fed dry to the twin-screw extruder. In typical LOVA gun propellant formulations, the oxidizer particle size is controlled to less than 5 microns for the weight-mean-diameter. In the extruder, the materials are thoroughly mixed and the solvent is reduced to a sufficient level for direct extrusion through the desired dies. The solvent is reduced by applying a temperature profile along the extruder barrel and using a vacuum sweep to collect the solvent vapors from the vacuum port.

The materials are mixed, de-solvated and extruded in approximately 2 minutes total passage time in the extruder. This represents a dramatic improvement over current batch processes which may require approximately 8 hours. The strands are extruded horizontally so that the necking observed in the batch process is avoided.

An important feature of the present invention is the choice of solvent. The desired solvent system will vary depending on the choice of oxidizer and binder. The solvent is selected to dissolve the non-oxidizer ingredients and to adequately wet the oxidizer particles. Some solvent must be present during the final extrusion such that the binder remains plasticized. Thus, excess solvent is removed as the ingredients pass through the extruder.

Mixed solvent systems may be particularly useful in the manufacturing processes of the present invention. For instance, a mixture of solvents having different boiling temperatures may be chosen such that the excess solvent is low boiling while the high boiling solvent is present in an amount sufficient to permit extrusion of the propellant formulation. Thus, a suitable temperature profile which evaporates the excess solvent, yet retains the solvent needed for extrusion, is easily maintained.

Suitable solvents are preferably selected from commonly used organic solvents such as ketones, esters, and alcohols. Typical ketones include acetone and methyl ethyl ketone (MEK). Typical esters include acetates such as methyl acetate, ethyl acetate, and butyl acetate. Typical alcohols include methanol, ethanol, isopropyl alcohol, and propanol.

In one currently preferred process according to the present invention, a LOVA formulation includes RDX as the oxidizer and cellulose acetate butyrate is the binder. In this system, the solvent includes acetone and a mixture of ethyl acetate/ethyl alcohol. The ethyl acetate/ethyl alcohol mixture preferably has a weight ratio in the range from about 70:30 to about 90:10 ethyl acetate to ethyl alcohol. All of the ingredients, except the RDX, are dissolved in the solvent mixture to form a lacquer solution. The lacquer solution is then pumped directly into the extruder, preferably with a computer controlled pump. The RDX is fed through a loss-in-weight feeder into the lacquer and mixed by the twin screw extruder. A loss-in-weight feeder is currently preferred instead of a typical volumetric feeder because it allows computer control of the actual weight of RDX introduced into the twin-screw extruder. Thus, the process of the present invention permits accurate control of the LOVA propellant formulation.

The amount of solvent introduced into the extruder with the propellant ingredients is preferably in the range from about 30% to about 36%, by weight. It will be appreciated that this amount may range from about 20% to about 50% depending on the choice of oxidizer, binder, and solvent system, but the amount of solvent will usually range from about 24% to about 40%, by weight. As the ingredients pass through the extruder, the amount of solvent is reduced to an amount sufficient to keep the binder plasticized during extrusion. In the context of the LOVA propellant containing RDX and CAB, discussed above, the amount of solvent remaining at the time of extrusion is preferably about 10%±1%, by weight.

The extruder screw configuration is very important to the processing of the composition. For example, a typical screw configuration will include a conveying section where the ingredients are introduced into the extruder, one or more kneading sections where the ingredients are mixed, a section to cause the ingredients to completely fill that screw section and create a dynamic seal, a conveying section in which a vacuum may be applied to facilitate solvent removal, and another conveying section designed to build up pressure to force the mixed ingredients through the extruder dies. Those skilled in the art understand that the optimal extruder configuration depends on composition being extruded, including the composition's ingredients and solvent content.

As the LOVA propellant ingredients pass through the extruder, they are preferably subjected to a temperature profile designed to facilitate mixing and solvent removal. For instance, the temperature at the feed point is preferably sufficiently cool that the solvent is not evaporated until mixing occurs. After mixing, the propellant mixture is heated to evaporate excess solvent. The solvent is collected by vacuum for solvent reclamation. In connection with the RDX/CAB LOVA formulation mentioned above, the temperature is high enough to evaporate the acetone, but not so high that the ethyl acetate or ethyl alcohol is evaporated. This mixed solvent system provides greater control in maintaining a suitable solvent level at the die.

The extrusion is accomplished as the composition reaches the proper solvent level. The strands are cut as they come from the extruder, thereby further reducing handling. This process may be automated and performed remotely, thereby safely producing a very high quality final product. The cost of producing LOVA by the process of the present invention is approximately 60% less than by the comparable batch mixing process.

The foregoing process can be adapted for use in preparing a wide variety of composite gun propellants. For example, a low-energy LOVA gun propellant is prepared substantially as described above. The gun propellant has the following formula:

| M39 Gun Propellant | |
|---|---|
| Ingredient | Weight % |
| RDX | 76 |
| CAB | 11 |
| ATEC | 6 |
| NC | 6.3 |
| EC | 0.4 |
| LICA-12 | 0.3 |

The cellulose acetate butyrate, acetyltriethylcitrate, nitrocellulose, ethyl centralite, and LICA-12 are dissolved in an ethyl alcohol/ethyl acetate solvent comprising about 70 parts ethyl acetate to about 30 parts ethyl alcohol. The lacquer solution is then pumped directly into the extruder using a computer controlled pump. The RDX is fed through a loss-in-weight feeder into the lacquer and mixed by the twin screw extruder. When all of the propellant ingredients are mixed in the solvent, the solvent represents about 26% of the mixture. The gun propellant is extruded after the solvent content is reduced to about 10%. The extruded gun propellant is cut into pellets and processed as described above.

From the foregoing it will be appreciated that the present invention provides a continuous composite gun propellant manufacturing process capable of safely producing high quality, low cost composite gun propellant. The present invention represents a significant improvement in cost, safety, and quality compared to current batch manufacturing processes.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method of making composite gun propellant comprising the steps of:

(a) introducing a lacquer solution into a twin-screw extruder, said lacquer solution containing a quantity of cellulose ester binder and nitrocellulose;

(b) adding a quantity of dry oxidizer to the twin-screw extruder, said oxidizer having a weight-mean-diameter particle size of less than about 5 microns; and (c) extruding the composite gun propellant with the twin-screw extruder, said extruding step including the steps of mixing the dry oxidizer and the lacquer solution and removing excess solvent from the oxidizer/lacquer solution mixture.

2. A method of making composite gun propellant as defined in claim 1, wherein the oxidizer is selected from HMX, RDX, CL-20, and mixtures thereof.

3. A method of making composite gun propellant as defined in claim 1, wherein the oxidizer has a weight percent in the composite gun propellant in the range from about 70 to about 80 weight percent.

4. A method of making composite gun propellant as defined in claim 1, further comprising the step of introducing a quantity of stabilizer and plasticizer into the twin-screw extruder.

5. A method of making composite gun propellant as defined in claim 1, wherein the lacquer solution further contains a quantity of stabilizer and plasticizer.

6. A method of making composite gun propellant as defined in claim 1, wherein the cellulose ester binder is selected from cellulose acetate, cellulose acetate butyrate and cellulose acetate propionate.

7. A method of making composite gun propellant as defined in claim 1, wherein the cellulose ester binder has a weight percent in the composite gun propellant in the range from about 10 to about 15 weight percent.

8. A method of making composite gun propellant as defined in claim 1, wherein the plasticizer is an energetic plasticizer having a weight percent in the composite gun propellant in the range from about 5 to about 10 weight percent.

9. A method of making composite gun propellant as defined in claim 8, wherein the plasticizer is selected from bis(2,2-dinitropropyl)acetal/bis(2,2-dinitropropyl)formal (BDNPF/BDNPA), trimethylolethanetrinitrate (TMETN), triethyleneglycoldinitrate (TEGDN), diethyleneglycoldinitrate (DEGDN), nitroglycerine (NG), butanetrioltrinitrate (BTTN), alkyl nitratoethylnitramines (NENA's), and mixtures thereof.

10. A method of making composite gun propellant as defined in claim 1, wherein the plasticizer is an inert plasticizer having a weight percent in the composite gun propellant in the range from about 5 to about 10 weight percent.

11. A method of making composite gun propellant as defined in claim 10, wherein the plasticizer is selected from triacetin, acetyltriethylcitrate (ATEC), dioctyladipate (DOA), isodecylperlargonate (IDP), dioctylphthalate (DOP), dioctylmaleate (DOM), dibutylphthalate (DBP), and mixtures thereof.

12. A method of making composite gun propellant as defined in claim 1, further comprising the step of applying a temperature profile along the twin-screw extruder.

13. A method of making composite gun propellant as defined in claim 1, wherein the twin-screw extruder contains a vacuum port and wherein the method further comprises the step of applying a vacuum to the vacuum port to collect solvent vapors.

14. A method of making composite gun propellant as defined in claim 1, wherein the composite gun propellant is extruded horizontally.

15. A method of making composite gun propellant as defined in claim 1, wherein the lacquer solution contains a mixture of solvents.

16. A method of making composite gun propellant as defined in claim 15, wherein the mixture of solvents is selected from an organic ester, organic ketone, organic alcohol, and mixtures thereof.

17. A method of making composite gun propellant as defined in claim 15, wherein the mixture of solvents is selected from ethyl acetate, acetone, ethyl alcohol, and mixtures thereof.

18. A method of making composite gun propellant as defined in claim 1, further comprising the step of cutting the extruded composite gun propellant into pellets.

19. A method of making composite gun propellant as defined in claim 18, further comprising the step of drying the composite gun propellant pellets.

20. A method of making composite gun propellant as defined in claim 19, further comprising the step of glazing the composite gun propellant pellets with graphite to prevent static charges and improve packing.

21. A method of making composite gun propellant comprising the steps of:

(a) introducing a lacquer solution into a twin-screw extruder, said lacquer solution comprising:

a cellulose ester binder having a weight percent in the composite gun propellant in the range from about 10 to about 15 weight percent, and nitrocellulose having a weight percent in the composite gun propellant in the range from about 2 to about 5 weight percent, wherein the foregoing ingredients are dissolved in a solvent;

(b) adding a quantity of dry oxidizer selected from HMX, RDX, CL-20, and mixtures thereof to the twin-screw extruder, said oxidizer having a weight-mean-diameter particle size of less than about 5 microns, said oxidizer having a weight percent in the composite gun propellant in the range from about 70 to about 80 weight percent; and (c) extruding the composite gun propellant with the twin-screw extruder, said extruding step including the steps of mixing the dry oxidizer and the lacquer solution and removing excess solvent from the oxidizer/lacquer solution mixture.

22. A method of making composite gun propellant as defined in claim 21, wherein the cellulose ester binder is selected from cellulose acetate, cellulose acetate butyrate, and cellulose acetate propionate.

23. A method of making composite gun propellant as defined in claim 21, further comprising the step of introducing a quantity of stabilizer and plasticizer into the twin-screw extruder, said stabilizer having a weight percent in the composite gun propellant in the range from about 0.2 to about 1 weight percent and said plasticizer having a weight percent in the composite gun propellant in the range from about 5 to about 10 weight percent.

24. A method of making composite gun propellant as defined in claim 21, wherein the lacquer solution further comprises:

a stabilizer having a weight percent in the composite gun propellant in the range from about 0.2 to about 1 weight percent, and a plasticizer having a weight percent in the composite gun propellant in the range from about 5 to about 10 weight percent.

25. A method of making composite gun propellant as defined in claim 21, wherein the plasticizer is an energetic plasticizer.

26. A method of making composite gun propellant as defined in claim 25, wherein the plasticizer is selected from bis(2,2-dinitropropyl)acetal/bis(2,2-dinitropropyl)formal (BDNPF/BDNPA), trimethylolethanetrinitrate (TMETN), triethyleneglycoldinitrate (TEGDN), diethyleneglycoldinitrate (DEGDN), nitroglycerine (NG), butanetrioltrinitrate (BTTN), alkyl nitratoethylnitramines (NENA's), and mixtures thereof.

27. A method of making composite gun propellant as defined in claim 21, wherein the plasticizer is an inert plasticizer.

28. A method of making composite gun propellant as defined in claim 27, wherein the plasticizer is selected from triacetin, acetyltriethylcitrate (ATEC), dioctyladipate (DOA), isodecylperlargonate (IDP), dioctylphthalate (DOP), dioctylmaleate (DOM), dibutylphthalate (DBP), and mixtures thereof.

29. A method of making composite gun propellant as defined in claim 21, further comprising the step of applying a temperature profile along the twin-screw extruder.

30. A method of making composite gun propellant as defined in claim 21, wherein the twin-screw extruder contains a vacuum port and wherein the method further comprises the step of applying a vacuum to the vacuum port to collect solvent vapors.

31. A method of making composite gun propellant as defined in claim 21, wherein the composite gun propellant is extruded horizontally.

32. A method of making composite gun propellant as defined in claim 21, wherein the lacquer solution contains a mixture of solvents.

33. A method of making composite gun propellant as defined in claim 32, wherein the mixture of solvents is selected from an organic ester, organic ketone, organic alcohol, and mixtures thereof.

34. A method of making composite gun propellant as defined in claim 32, wherein the mixture of solvents is selected from ethyl acetate, acetone, ethyl alcohol, and mixtures thereof.

35. A method of making composite gun propellant as defined in claim 21, further comprising the step of cutting the extruded composite gun propellant into pellets.

36. A method of making composite gun propellant as defined in claim 35, further comprising the step of drying the composite gun propellant pellets.

37. A method of making composite gun propellant as defined in claim 36, further comprising the step of glazing the composite gun propellant pellets with graphite to prevent static charges and improve packing.

38. A method of making composite gun propellant comprising the steps of:

(a) drying a quantity of RDX;

(b) grinding the RDX to a weight-mean-diameter particle size of less than about 5 microns;

(c) preparing a lacquer solution by dissolving a quantity of cellulose ester, nitrocellulose, ethyl centralite, a liquid coupling agent, and an energetic plasticizer in a solvent containing acetone;

(d) pumping the lacquer solution into a twin-screw extruder;

(e) introducing the dry RDX to the twin-screw extruder;

(f) extruding the composite gun propellant with the twin-screw extruder, said extruding step including the steps of mixing the dry RDX and the lacquer solution and removing excess solvent from the RDX/lacquer solution mixture, wherein the composite gun propellant is extruded horizontally;

(g) cutting the extruded composite gun propellant into pellets;

(h) drying the pellets; and (i) glazing the pellets with graphite to prevent static charges.

39. A method of making composite gun propellant as defined in claim 38, wherein the lacquer solution contains a mixture of solvents selected from ethyl acetate, acetone, ethyl alcohol, and mixtures thereof.

40. A method of making composite gun propellant as defined in claim 38, wherein the plasticizer is selected from bis(2,2-dinitropropyl)acetal/bis(2,2-dinitropropyl)formal (BDNPF/BDNPA), trimethylolethanetrinitrate (TMETN), triethyleneglycoldinitrate (TEGDN), diethyleneglycoldinitrate (DEGDN), nitroglycerine (NG), butanetrioltrinitrate (BTTN), alkyl nitratoethylnitramines (NENA's), and mixtures thereof.

41. A method of making composite gun propellant as defined in claim 38, further comprising the step of applying a temperature profile along the twin-screw extruder.

42. A method of making composite gun propellant as defined in claim 38, wherein the twin-screw extruder contains a vacuum port and wherein the method further comprises the step of applying a vacuum to the vacuum port to collect solvent vapors.

* * * * *